US007927673B2

(12) United States Patent
Thomas

(10) Patent No.: US 7,927,673 B2
(45) **Date of Patent: *Apr. 19, 2011**

(54) STAR-SHAPED DECORATIVE OBJECT

(76) Inventor: Gotz Thomas, Itzehoe (DE)

( * ) Notice: Subject to any disclaimer, the term of this patent is extended or adjusted under 35 U.S.C. 154(b) by 634 days.

This patent is subject to a terminal disclaimer.

(21) Appl. No.: 11/577,579

(22) PCT Filed: Oct. 12, 2005

(86) PCT No.: PCT/EP2005/010947

§ 371 (c)(1),
(2), (4) Date: Aug. 30, 2007

(87) PCT Pub. No.: WO2006/045434

PCT Pub. Date: May 4, 2006

(65) Prior Publication Data

US 2009/0092773 A1 Apr. 9, 2009

(30) Foreign Application Priority Data

Oct. 21, 2004 (DE) ..... 10 2004 051 251

(51) Int. Cl.
*A47G 33/04* (2006.01)

(52) U.S. Cl. ..... 428/11; 428/7; 428/12

(58) Field of Classification Search ..... None
See application file for complete search history.

(56) References Cited

U.S. PATENT DOCUMENTS 2,199,435 A 5/1940 Koonz
2,653,216 A * 9/1953 Protz ..... 362/121
4,930,053 A 5/1990 Vaught
5,280,627 A 1/1994 Flaherty et al.
(Continued)

FOREIGN PATENT DOCUMENTS

CN 1163006 10/1997
(Continued)

OTHER PUBLICATIONS

International Search Report issued in corresponding PCT application No. PCT/EP2005/010947 issued Dec. 21, 2005.

*Primary Examiner* — Gordon R Baldwin
(74) *Attorney, Agent, or Firm* — Lempia Summerfield Katz LLC

(57) ABSTRACT

The invention relates to a star-shaped decorative object (2), in addition to blanks and an associated production method. The decorative object comprises at least two interconnected blanks (4, 6; 58, 60; 66, 72) consisting of paper or foil, at least one (4, 6; 58, 60; 72) of which comprises a central part (12) and a plurality of points (8, 10; 74, 76) projecting outwards beyond the central part (12). The central part (12) of said blank (4, 6; 58, 60; 72) is provided with several fold lines (24) that run from a central point (26) towards the points (8, 10; 74, 76) and is folded alternately along adjoining fold lines (24) in opposite directions in a V, in such a way that between two respective fold lines (24) that are separated by an additional fold line (24), areas (44 and 40) that are folded inwards and outwards are formed with the additional fold line (24) running through their center. To interconnect the two blanks (4, 6; 58, 60; 66, 72) to form a hollow three-dimensional body, the points (8) are pushed through openings (28; 70) of one of the other blanks (6, 4; 60, 58; 66) in areas of the folded blank (4, 6; 58, 60; 72) that are folded inwards (44).

19 Claims, 17 Drawing Sheets

U.S. PATENT DOCUMENTS 5,309,333 A * 5/1994 Kandampully ..... 362/121

FOREIGN PATENT DOCUMENTS

| | | |
|---|---|---|
| DE | 1735277 | 12/1956 |
| DE | 8516185 | 10/1985 |
| DE | 3618092 | 12/1986 |
| DE | 9011320 | 1/1991 |
| DE | 19609168 | 7/1999 |
| EP | 0 654 733 A1 | 5/1995 |
| WO | WO 94/27234 | 11/1994 |

* cited by examiner

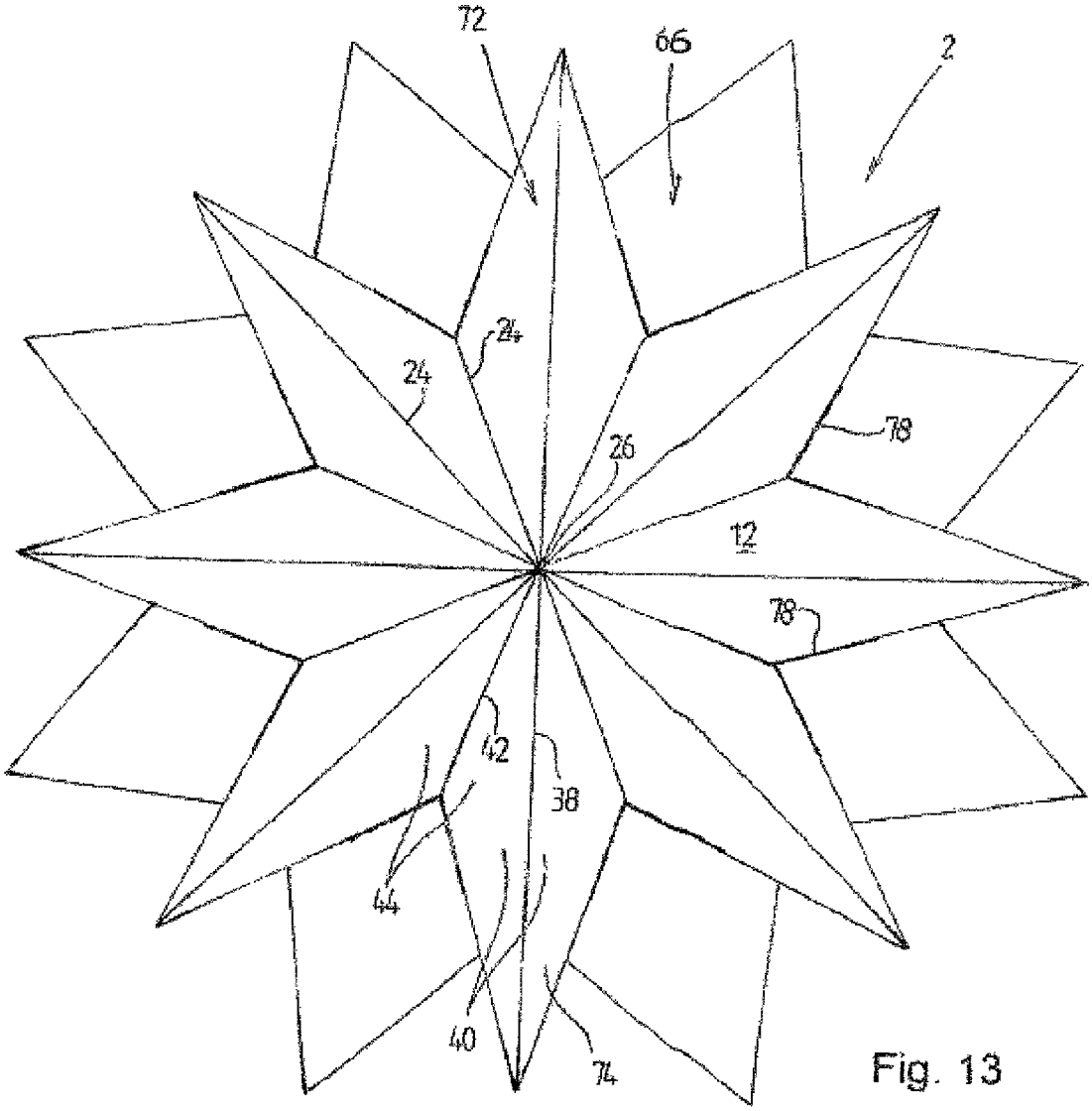
Fig. 13
Fig. 14
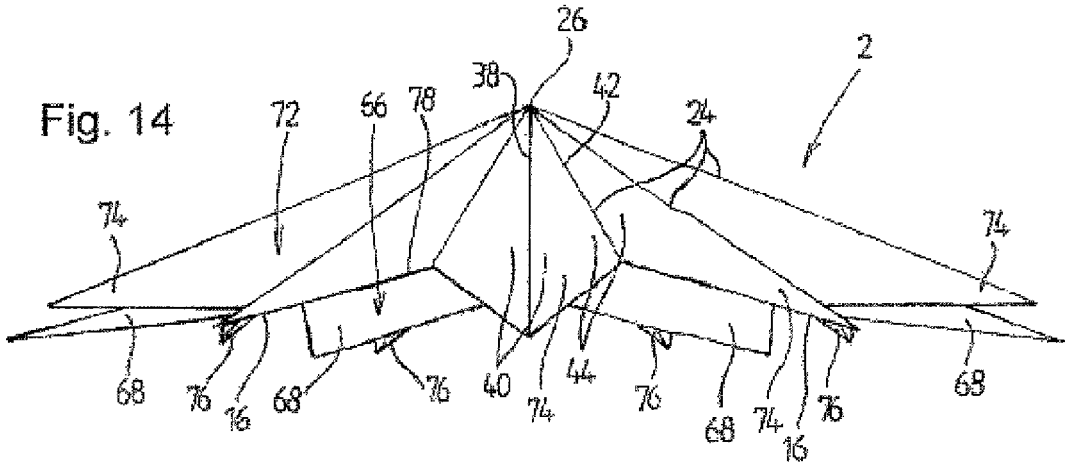

STAR-SHAPED DECORATIVE OBJECT

RELATED APPLICATION DATA

This patent is related to, claims priority benefit of, and is a U.S. National Phase Application of International Application No. PCT/EP2005/010947, which was filed on Oct. 21, 2005, and which claimed priority benefit of a German National Patent Application filed on Oct. 21, 2004, each of which is incorporated herein by reference in their entirety.

FIELD OF THE INVENTION

The invention concerns a three-dimensional star-shaped decorative article or decorative object, especially for use as a Christmas window decoration or Christmas tree ornament, consisting of two or more blanks made of a paper or foil material, joined together, as well as a method and a set of blanks for its manufacture.

BACKGROUND OF THE INVENTION

Three-dimensional stars for decoration purposes during the Advent or Christmas season or as window decoration or Christmas tree ornament, produced by folding from paper blanks, are known, for example, a star marketed under the name of "Annaberg Window Star" [Annaberger Fensterstere] or "Erzgebirg Window Star" ["Erzgebirgischer Fensterstern"] with eight closed points extending in a circle over a middle part. There, on opposite sides of the star, the paper or foil material is provided with sixteen radially-extending fold lines, whereby it is folded in a V-shape in opposite directions at neighboring fold lines. By means of this alternating folding, areas that are folded inwardly are formed between two fold lines running through the tips of neighboring points, through the middle of which a fold line extends to a re-entering corner between the two neighboring points. Conversely, the fold lines that run from the middle of each side of the star to two neighboring re-entering corners define outwardly-folded areas through the middle of which the fold lines extend to the points of the star. Similar known stars with points extending outwards radially in several directions, known under the name of "Herrenhut star" are known from DE 36 18 092 A1, from DE 90 11 320 U1, from DE 85 16 185 U1 or from DE 196 09 168 C2. However, to produce these stars, several blanks and/or parts must be glued together, which is only possible manually, at a relatively high cost.

Furthermore, it is known from the origami technique that two-dimensional and three-dimensional stars with a different number of points can be produced from several paper blanks merely by folding. In order to achieve the holding together of the individual blanks without glue, normally a pocket is folded into each blank into which a part of a neighboring blank is inserted and this is also relatively costly and time-consuming.

Furthermore, a decorative Christmas star is disclosed in DE 1 735 277 U1. This folded star consists of two identical folded foil blanks joined together, each of which has a middle part as well as four longer and four shorter points extending outwardly beyond the middle part. Each blank is provided with eight fold lines which run from the midpoints of their middle parts to the tips of the points. The two blanks are folded in a V-shape alternately in opposite directions at the fold lines and then brought together in such a way that the midpoints of their middle parts point in opposite directions and the points are rotated by 45 degrees so that the shorter points of one blank come to lie in the recesses formed by the longer points of the other blank, wherein a mutual fixation on the blanks occurs that is not described in more detail.

Based on this, the task of the invention is to provide an aesthetically pleasing star-shaped three-dimensional decorative article from two or more blanks joined together, made of a paper or foil material, as well as to provide a method and a set of blanks for its production, making it possible to produce the decorative article without gluing and at a low cost.

SUMMARY OF THE INVENTION

This task is solved by the invention according to the features of the disclosed decorative object.

Surprisingly, it was found that a decorative object with features as disclosed herein makes it possible to assemble two or more blanks without glue to form a stable three-dimensional star, which has an essentially closed body and points that extend wreathlike beyond the body.

The decorative article according to the invention can be used for purposes other than advent or Christmas decorations, for example as a lampshade or packaging container.

At least one of the blanks must be star-shaped and have a middle part, several points extending beyond this outwardly and a plurality of fold lines that run from a point in the middle of the middle part in the direction of the points, so that the blank can be folded along neighboring fold lines alternately in opposite directions into a V-shape, whereby in each case, between two fold lines, separated by an additional fold line, inwardly-folded and outwardly-folded areas respectively are formed, with the additional fold line in their middle. When only two blanks are used, the other, preferably also star-shaped blank can be flat and can have all the openings required for joining the blanks. Since, however, these blanks have a very appealing three-dimensional form only when viewed from one of their sides, and therefore are mostly used as wall or table decoration, a preferred embodiment of the invention provides that the second blank has a form similar to or preferably identical to the said first blank, through which the production of the folded star can also be simplified. Then the middle part of the second blank also has several fold lines, running from a midpoint in the direction of the points and is folded alternately in opposite directions at neighboring fold lines. In order to join the two blanks, in this case the points on the inwardly-folded areas of one of the blanks are introduced through openings in the outwardly-folded areas of the other blank, as a result of which the folded star assumes an appealing three-dimensional form when viewed from either side.

The through openings in the blank or blanks are expediently designed in such a way that they have a rotational symmetry with respect to the midpoint of the particular blank. When using two blanks that are provided with fold lines or that are folded, with alternating longer and shorter points, the through openings are preferably arranged in the longer points, whereby their distance from the midpoint is preferably smaller than the distance from the tips of the shorter points and larger than the latter's distance from the re-entering corners between the points.

When three or more blanks are used, preferably two of the blanks are folded along the fold lines alternately in opposite directions in a V-shape, while the other blank or blanks are expediently essentially flat and are sandwiched between the folded blanks, whereby the openings for the inwardly-folded regions of the folded blanks are stamped out either in one or both of the flat blanks and/or in the other folded blank.

For better explanation, within the framework of this application, an "inwardly" or "outwardly" folded area of a blank of the finished three-dimensional decorative article is understood to be an area consisting of two neighboring slanting flanks of the blank, which always extend on both sides of a fold line to the respective neighboring fold line. Hereby, the middle fold line, which divides the area into two halves, forms the bottom line of a valley which has an approximately V-shaped cross-section, or the vertex line of a peak, which has an approximately V-shaped cross-section, whereby the outsides of the two flanks enclose an angle of less than 180 degrees in the first case and an angle of more than 180 degrees in the second case. Where neighboring fold lines, according to a preferred embodiment of the invention, run from the midpoint of each blank to the tips of neighboring points, each of the inwardly-folded or outwardly-folded areas respectively extends between one fold line and the fold line after the next one. The directional statements "inwardly" or "outwardly" refer to the already folded blank, namely when looking at their raised sides, the middle parts of which, in the finished three-dimensional decorative article, form the outside of the decorative article, which will also be referred to below simply as folded star.

Since the inwardly-folded and outwardly-folded areas follow each other alternately around the midpoint of each blank that is provided with fold lines, preferably each of the outwardly-folded areas of each blank is provided with a through opening and each of the inwardly-folded areas is provided with a point, which is introduced through a through opening in the opposing outwardly-folded area of the other blank, in order to join the two blanks by interleaving with one another.

When, during the manufacture of the folded star, the two blanks become somewhat compressed, when a part of their point is being introduced into the through openings of the other blank, and are, as a result, somewhat more strongly folded than before, due to the inherent elasticity of the paper or foil material, subsequently the blank has the tendency to return to a flatter, less strongly folded form. This counteracts an undesired separation of the two blanks, which are joined together, and leads to a more solid seating of the points in the through openings, especially when the opening cross-section of the latter ones corresponds approximately to the profile of the former ones. When during handling of the star pressing forces are applied onto the blanks from the outside, the latter ones spread out again, whereby the points penetrate further into the openings and thus the undesired separation of the blanks is similarly counteracted.

To prevent an unintended separation of the blanks, even when opposing tensile forces are applied to these, according to a preferred embodiment of the invention, it is provided that at least some of the points are interlocked with the other blank when inserted into the through openings, so that the points can no longer come loose from the through openings on their own. Preferably, the interlocking is achieved by providing at least some of the points with a notch on the inwardly-folded areas of each blank on one or both side edges of the points, the notch holding expediently an opposing end of the opening. However, alternatively, the openings can also be stamped out so that one or several projections extend beyond one of their opposite bordering edges, these projections being bent over, when a point is introduced, and penetrates into an opening stamped out from this point when the point has been inserted into the opening as far as prescribed.

Preferably, the openings are essentially in the form of V-shaped slit openings, which are stamped out expediently near a baseline which interconnects re-entering corners on both sides of the point. In the blanks provided with fold lines, expediently, an opening is stamped out only in every other point, whereby, in the case of blanks with alternating shorter and longer points, the opening is arranged in the respective longer points or in an adjoining area of the middle part bordering it, while the respective shorter point is inserted with its tip through a through opening in the other blank.

In order to facilitate the insertion of the points into the slit openings, their opposite bordering edges, over the entire length or over a part of the length of the openings, can have a small distance that is expediently two to ten times the thickness of the blank. The slit openings are preferably symmetrical with respect to the fold lines at the vertex lines of the outwardly-folded areas. Preferably, hereby, at least one of the two opposite bordering edges, expediently the outer bordering edge of each slit opening, is composed of two edge sections that converge in a V-shape in the direction of the fold line. The angle between the converging edge sections corresponds expediently to the angle of the cross-sectional profile of the point of the other blank inserted through the slit opening. In order to prevent a tearing of the slit openings at their ends, these latter ones can be rounded or provided with small rounded extensions.

The thickness of the finished folded star, that is, the mutual distance of the midpoints of the two blanks, can be altered while keeping the shape of the points essentially the same, by shifting the openings either closer to the midpoint of each blank, as a result of which the stars become thicker, or by shifting them further toward the tips of the points, as a result of which the stars become thinner. As already mentioned, the openings are preferably arranged near the foot of each point, that is, near the baseline which interconnects two neighboring re-entering corners on both sides of the respective point.

In order to insure that the middle parts of the two blanks surround an essentially completely closed cavity, another preferred embodiment of the invention provides that the two blanks lie against one another at their re-entering corners between neighboring points. Moreover, the opposite edges of each point entering through an opening are preferably formed between the ends of this opening and the two re-entering corners adjoining the point in such a way that they correspond there to the cross-sectional form of the outwardly-folded area provided with the opening. In this case, the two blanks are in line contact not only within the openings but also on both sides of them. Such a peripheral line contact between the two blanks can be achieved especially well in the case of triangular points when, on the inwardly-folded areas in the area of their foot, the points are somewhat narrower than or, as a maximum, exactly as wide as the points on the outwardly-folded areas of each blank, which are provided with openings.

In any case, for aesthetic reasons, it may be preferable to leave gaps between the blanks in order to achieve light-and-shadow effects or to create light exit openings for a light source arranged inside the star.

The folded star according to the invention can be varied in many other ways as well, for example with regard to material, which can be tinted cardboard or transparent, translucent or opaque plastic film, but can consist alternatively of multilayer glued colored transparent Chinese paper or a metal foil; the material thickness or area weight respectively, of the blanks, which are preferably in the range of 0.25 mm to 2 mm or 50 $g/m^2$ to 400 $g/m^2$, depending on the material; the surface properties of the visible surfaces of the star, which can be smooth, rough or embossed; possible coatings on all or a part of the surfaces, for example glitter, metallization, gold or silver spray; breakthroughs or perforations in the blanks; as well as, naturally, the three-dimensional shape of the star, which can be adapted to satisfy almost any taste by changing the number of points, for example 6, 8, 10, 12, etc., the length of the points, the arrangement of longer and shorter points or differing lengths of the longer points, the projecting length of the shorter points, the shape of the individual points, for example with straight, zig-zag or wavy edges or double tips on all or a part of the points, the proportions of the star, that is, the thickness-to-length ratio of the points, as well as the size of the star.

Preferably, the fold lines extend from the midpoint of the middle part to the tips of the points, however, they can also end closer to the midpoint, for example at the foot of the points or at the openings, as a result of which, especially in the area of the points instead of the V-shaped cross-sections, U-shaped cross-sections result. Expediently, the fold lines are directed radially, but they can also be bent in a slightly spiral form. In case of points with double tips, the fold lines can end between the two tips. Generally, within the framework of the present invention, the fold line is understood to mean a line that facilitates the folding of the blanks and it is preferably an embossed groove or a row of perforations.

Furthermore, two blanks of different color or blanks with differently-colored flat surfaces can be used, as a result of which, in the former case, looking at it from one side, points arranged next to one another have different colors, while in the latter case additionally the colored stars themselves have different colors when looked at them from the opposite sides. When a transparent film material is used, the fold lines facing away from the user can be seen through the other blank, by means of which the three-dimensional effect can be further enhanced. Furthermore, especially for the blanks of larger folded stars, a translucent material can also be used and a light source can be placed inside the folded star, which illuminates both middle parts from the inside. Especially beautiful lighting effects can be achieved when the two blanks do not lie tightly against one another near the through openings or if the points introduced through the through openings are provided with small cut-outs or perforations in front of the through openings. Then the light from the inside of the folded star can fall through the gap between the blanks or through the cut-outs or perforations onto the tips of the other blank neighboring the openings and can illuminate these from the outside while the rest of the folded star emits light from within.

Expediently, the light source is an incandescent light bulb connected to a power source through at least one cable, which is led out from the inside of the folded star expediently in the area of two neighboring re-entering corners of the two blanks, and which can also be used to hang the folded star. Furthermore, the folded stars according to the invention can also be applied around the incandescent lights of a string of lights. Hereby, one can use a cable of the string of lights for hanging, guiding it inside the star between two neighboring points and leading it out again from it between two other neighboring points. Alternatively, one of the blanks can have an opening in the middle for a light socket of the incandescent light which is plugged into a mounting of the light through the opening, whereby the blank is clamped in-between the socket and the mounting.

An especially interesting appearance of the folded star is obtained also when all or part of the points are folded reversed in the outwardly-folded areas on the far side of the openings, so that at least some of the openings are adjoined by an outwardly-folded area on their inner bordering edges and by an inwardly-folded tip of the point at their outer bordering edges. The outwardly-folded areas on the inner side of each opening and the inwardly-folded tips on their outside are joined hereby expediently by two thin material bridges preferably bordering the ends of the openings. Using such an arrangement, the introduction of the points into the openings can also be facilitated during the assembly of the two blanks because the openings will open fairly wide in this way without having an adverse influence on the holding together of the finished folded star.

The hanging of the folded star is preferably carried out with the aid of a loop of thread that is preferably attached to one of the longer points provided with an opening, whereby, expediently, either it is glued onto the inwardly-folded side of its tip or it is threaded through two round openings connected to the side edges of the blank by cut-outs.

In order to produce the decorative article according to the invention, at first two or three blanks are stamped out from a paper or foil material, of which at least one has a middle part, a plurality of points extending beyond the middle part and a number of fold lines, preferably corresponding to the number of points, the fold lines running from a midpoint of the middle part outwardly in the direction of the points, so that, after stamping out, this blank can be folded at adjacent fold lines in a V-shape in opposite directions. Hereby, between each two fold lines separated by another fold line, inwardly-folded and outwardly-folded areas respectively are formed, with the other fold line in the middle. At least one of the other blanks is provided with a number of through openings in the stamping out process, through which the tips of the points of the folded blank can be inserted or introduced in order to join the two blanks with each other. Preferably, two identical blanks are used, both of which are provided with shorter points at the inwardly-folded areas and with longer points at the outwardly-folded areas and in which through openings are stamped out along the fold lines to the tips of the longer points, through which through openings the points at the inwardly-folded areas of the other blank can be inserted in order to join the two blanks with each other.

In machine production, this last step is preferably performed simultaneously for all points inserted through an opening, by first bringing both blanks into a position in which the points at the inwardly-folded areas of each blank face the openings in the outwardly-folded areas of the other blank, before moving them towards one another along a straight line running through their midpoints, whereby first the points enter into the through openings and then, by means of a further approach, the blanks become somewhat spread out in order to anchor the points in the openings.

BRIEF DESCRIPTION OF THE DRAWINGS

The invention will be explained below with a few practical examples shown in the drawing. The following are shown:

FIG. 13 is a front view of a folded star made from a folded blank provided with fold lines and a flat blank;

FIG. 14 is a perspective side view of the folded star from FIG. 13;

DETAILED DESCRIPTION OF THE PREFERRED EMBODIMENT

The folded stars 2 shown in FIG. 1 to 12 consist of two identical blanks 4, 6 stamped out from cardboard or plastic film, folded and then assembled together, as well as of a loop made of thread 7 serving as hanger.

Figure 6:
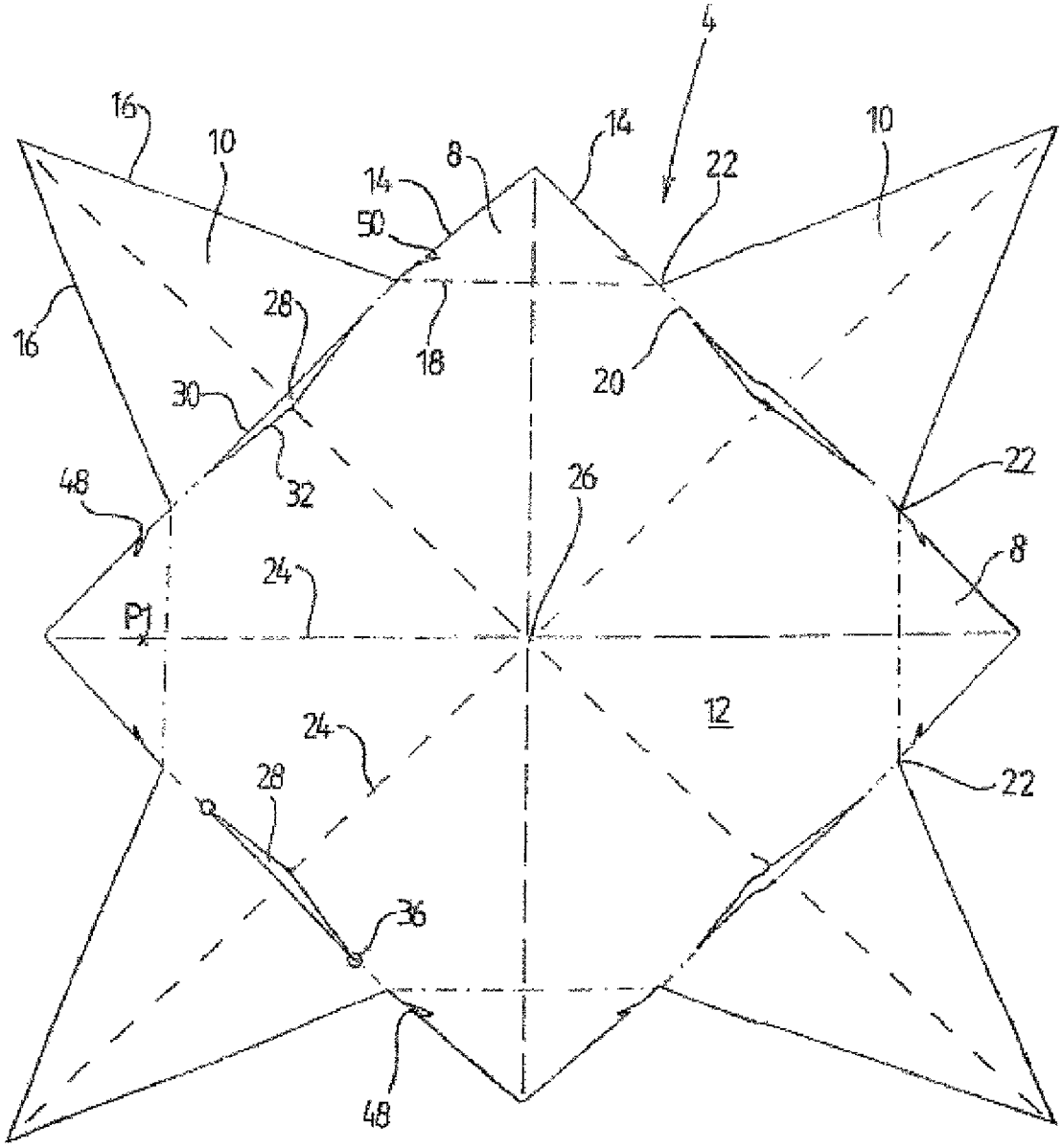
FIG. 6 is a top view onto a blank for the two halves of the folded star from FIG. 1

As depicted best in FIG. 6 based on the example of blank 4, each of the two blanks 4, 6 of the folded star 2 shown in FIGS. 1 to 5 has the shape of a flat eight-point star with four smaller points 8 and four larger points 10, which project outward beyond an eight-cornered middle part 12 and which are delineated each by two straight converging side edges 14 and 16, respectively. The middle part 12 is bordered toward the outside by imaginary baselines 18, 20, which, at the foot of each point 8, 10 connect the two re-entering corners 22 bordering the points 8, 10, as it is shown in FIG. 6 by the dash-dot lines.

When the blanks 4, 6 are stamped out of tinted cardboard or printed cardboard, this expediently has an area weight of at least 100 g/m$^2$, better still more than 120 g/m$^2$ and best of all more than 130 g/m$^2$, in order to obtain a finished folded star 2 with sufficient stiffness. When using colored or printed plastic film, depending on the size of the star, this has a thickness of at least 0.1 mm, better still at least 0.2 mm and best of all at least 0.25 mm.

Already during stamping, the blanks 4, 6 are provided with a total of four embossed, pressed or perforated straight fold lines 24, which each connect the tips of two opposite points 8, 10 with one another and all of which intersect in the middle of middle part 12 at a point 26. Moreover, during the stamping out, each of blanks 4, 6 is provided with four slit openings 28 that are arranged near the baseline 20 of each larger point 10, whereby they are oriented essentially transversely to the fold lines 24 running from the midpoint 26 to the tips of the larger points 10 and are symmetrical to the fold lines 24. In the blank 4 shown in FIG. 6, at their outer side facing the tips of points 10, the slit openings 28 have a straight bordering edge 30 lying on the baseline 20, while the bordering edge 32 on the inner side of the slit openings 28 is composed of two halves or edge sections which diverge outwardly at an obtuse angle. Alternatively, also both bordering edges 30, 32 can have diverging edge sections. The outer bordering edges 30 of slit openings 28 are at a distance from midpoint 26 that is smaller than the distance between the midpoint 26 and a point P1 on the fold lines 24 of the smaller points 8, at which the width of the smaller points 8 corresponds approximately to the width of the slit openings 28. In order to prevent a future tearing of the cardboard or of the plastic film, at the ends of slit openings 28, these ends can be provided with small circular extensions 36, as is indicated in a somewhat enlarged form at one of the slit openings 28 in FIG. 6.

During the folding of blanks 4, 6 following the stamping out, these are nicked or folded along the fold lines 24 between the tips of the larger points 10 in one direction and along the fold lines 24 between the tips of the smaller points 8 in the opposite direction, so that upon looking at them in the peripheral direction along baselines 18, 20, a flat, zig-zag shaped folding is obtained.

If one looks at the raised surface of a folded blank 4, 6, which, in the area of the middle part 12, forms the subsequent outside of the folded star 2, then each of the fold lines 24 between the tip of a larger point 10 and the midpoint 26 forms the vertex line 38 of an outwardly-folded area 40. This outwardly-folded area 40 consists of two slanting flanks adjoining each other along the vertex line 38, extending from there to the respective neighboring fold line 24 and forming a peak with a V-shaped cross-section, whereby their outsides enclose an angle of more than 180 degrees. Conversely, each of the fold lines 24 between the tip of a smaller point 8 and the midpoint 26, when viewed from the subsequent outside of the folded star 2, forms the bottom line 42 of an inwardly-folded area 44, which is composed of two slanted flanks adjoining each other along bottom line 42 and which extend from the bottom line 42 to the respective neighboring vertex line 38 and form a valley with a V-shaped cross-section, whereby their outsides enclose an angle of less than 180 degrees. Each of the two flanks of the outwardly-folded areas 40 at the same time forms a flank of an inwardly-folded area 44 neighboring it in the clockwise or counterclockwise direction. In other words, the fold lines 24 meeting at midpoint 26 delineate pairwise areas 40, 44 having V-shaped cross-sections that are folded inwardly and outwardly, alternately.

Next, the two folded blanks 4, 6 are aligned so that, first of all, the midpoints 26 of their middle parts 12 point in opposite directions and lie on a common straight line, which is perpendicular to the planes defined by the tips of the longer points 10 or by the tips of the shorter points 8 or by the re-entering corners 22 between points 8, 10, respectively, and that, secondly, opposite each larger point 10 of a blank 4, there is a smaller point 8 of the other blank 6; that is, the two blanks 4, 6 are rotated by 45 degrees with respect to one another around the straight line through the midpoints 26. Furthermore, the two blanks 4, 6 are briefly folded more strongly by reducing the angle between the outsides of the flanks of the inwardly-folded areas 44, until the tips of the smaller points 8 of each blank 4, 6 are positioned accurately opposite from the middle of the slit openings 28 of the respective other blank, 6, 4. This is always possible, at least when the midpoint angles between two neighboring fold lines 24 of the blanks 4, 6 are all the same and the tips of the smaller points 8 as well as the centers of the slit openings 28 lie on the fold lines 24.

Then the two blanks 4, 6 are moved towards each other along the straight lines through the midpoints 26 of their middle parts 12 until the smaller points 8 enter with their tips into the slit openings 28 of the larger points 10 and penetrate into these simultaneously until their side edges 14, which diverge toward the middle part 12, contact the ends of the slit openings 28. Then the two blanks 4, 6 are slightly spread out by enlargement of the angle between the outsides of the flanks of the inwardly-folded areas 44, while the smaller points 8 penetrate further into the slit openings 28 until they project a little distance with their tips beyond the other blank 6, 4 on the opposite side of the folded star 2. The spreading of the blanks 4, 6 leads to a mutual interleaving thereof because hereby the distance between the tips of the smaller points 8 and the straight line through the midpoints 26 of the middle parts 12 of the two blanks 4, 6 increases faster than the distance between this straight line and the slit openings 28 in the outwardly-folded areas 40.

When, during transportation or handling, pressing forces are applied to the middle parts of the two blanks 4, 6 of the completed folded star 2, this also leads to the spreading of the blanks 4, 6, through which, the smaller points 8, to the extent it is still possible, move a few millimeters further into the slit openings 28. Therefore, the holding together of the two blanks 4, 6 is not harmed by the pressing forces, but, on the contrary, it is improved. If a pressing force is applied to a smaller point 8 that projects through a slit opening 28, due to the interleaving of the blanks 4, 6 at the other points 8, 10, this does not lead to the exit of the point 8 from the slit opening 28 either. However, if the need arises, the two blanks 4, 6 of the folded star 2 can be separated by gripping them in the area of their middle parts 12 and pulling them apart. However, this can also be prevented by assuring that upon introduction of the points 8 into the slit openings 28, these interlock with the latter. For this purpose, the smaller points 8 are provided with small notches or cut-outs 48 on their opposite side edges 14, as shown in FIG. 6. With these notches or cut-outs 48, the opposite ends of the slit openings 28 engage when the points 8 are introduced as far as possible into the slit openings 28. The notches or cut-outs 48 are arranged in a region of the points 8 where these have essentially the same width as the slit openings 28. The notches or cut-outs 48 are designed so that, together with the side edges 14 of the points 8, they form small barbs 50, which can interlock at the ends of the slit openings 28. Entry of these barbs 50 through the slit openings 28 when the respecting point 8 is introduced is achieved due to the fact that the point 8 deforms somewhat in the slit opening 28.

After the joining of the two blanks 4, 6, their middle parts 12 enclose a cavity 52 (FIG. 5) in the form of a polyhedron, which has almost closed peripheral contacting lines, due to a mutual contact of the two blanks 4, 6, on both sides of each slit opening 28 and in the region of the re-entering corners 22, when the blanks 4, 6 have approximately the sizes or size relationships shown in the drawing. In these blanks 4, 6, the smaller points 8 at the inwardly-folded areas 44, are, on the one hand, shorter and in the area of their baseline 18 somewhat narrower than the larger points 10 at the outwardly-folded areas 40. On the other hand, their side edges 14 are approximately in alignment with bottom lines 20 of the adjoining larger points 10. Thus the side edges 14 of the smaller points 8 and the baselines 20 of the larger points 10 approximately delineate a polygon in which the number of corners corresponds to half of the number of points 8, 10 of the blanks 4, 6. However, by changing the dimensions of the larger or longer and of the smaller or shorter points 8, 10, respectively, that is, their width and length as well as their relationships of length to breadth, folding stars 2 can also be produced in which the blanks 4, 6 do not lie against one another on either side of the slit openings 28 or do so only in sections.

Figure 1:
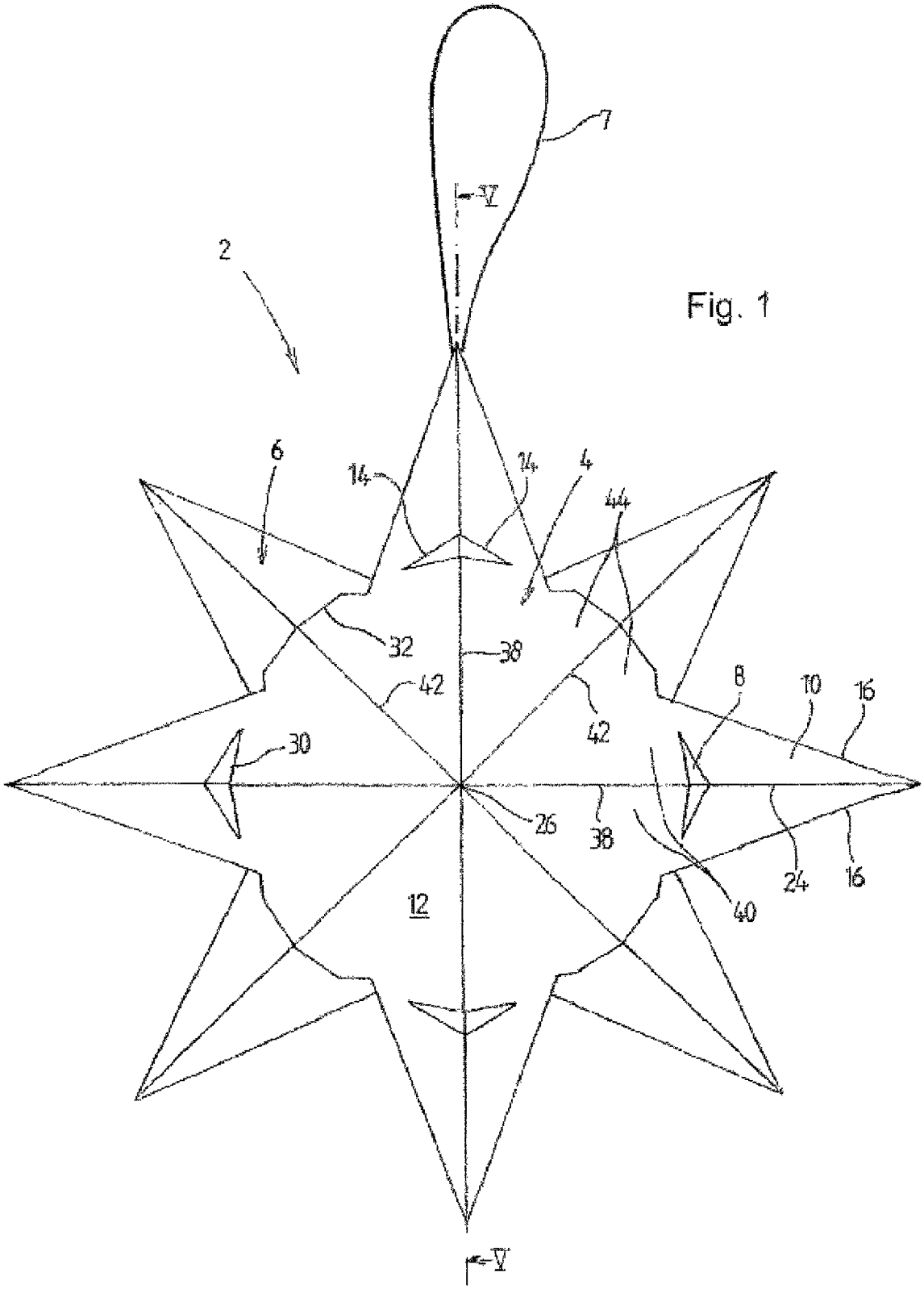
FIG. 1 is a front view of an eight-point folded star according to the invention.
Figure 2:
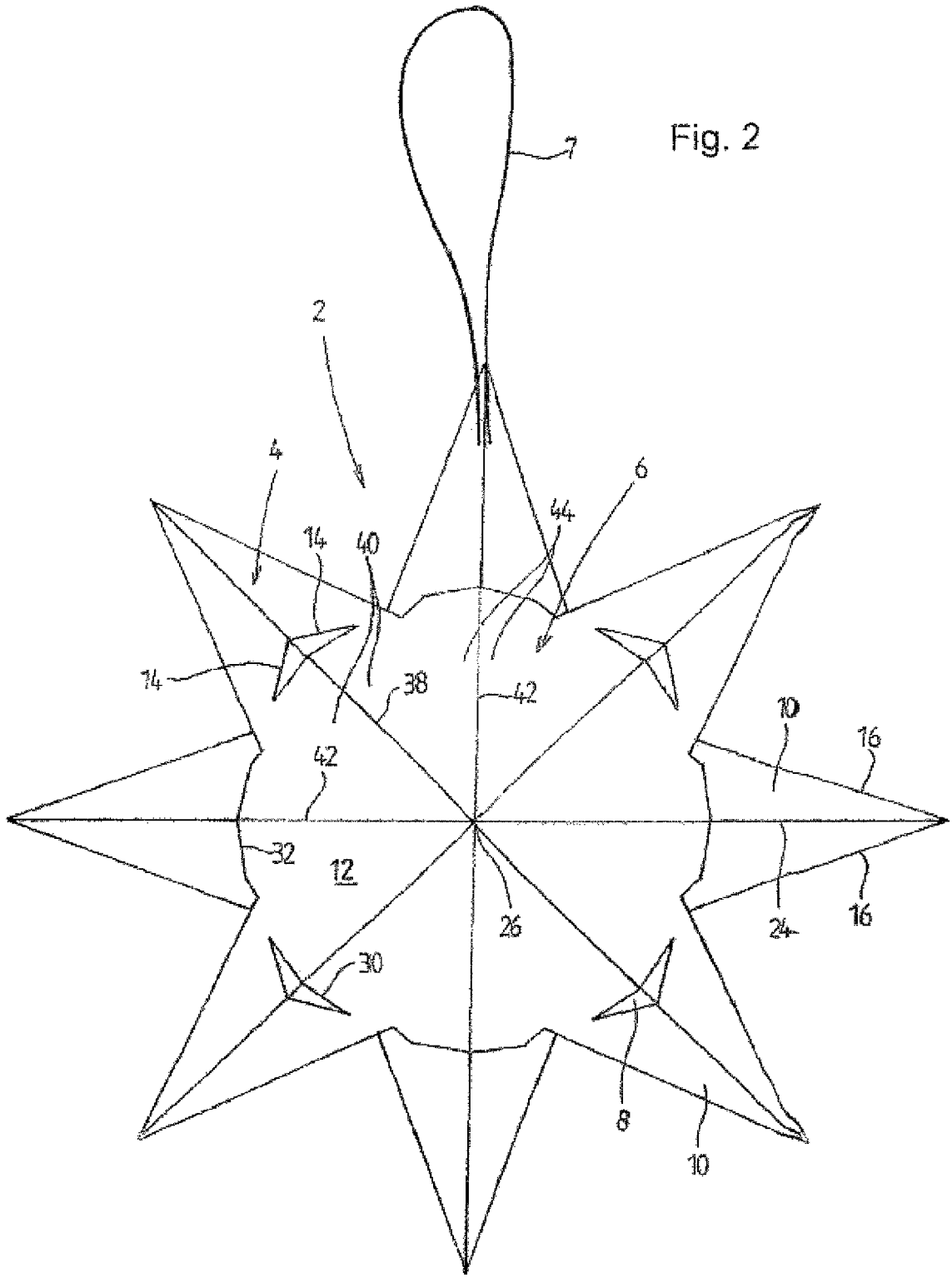
FIG. 2 is a view from the back of the folded star from FIG. 1.
Figure 3:
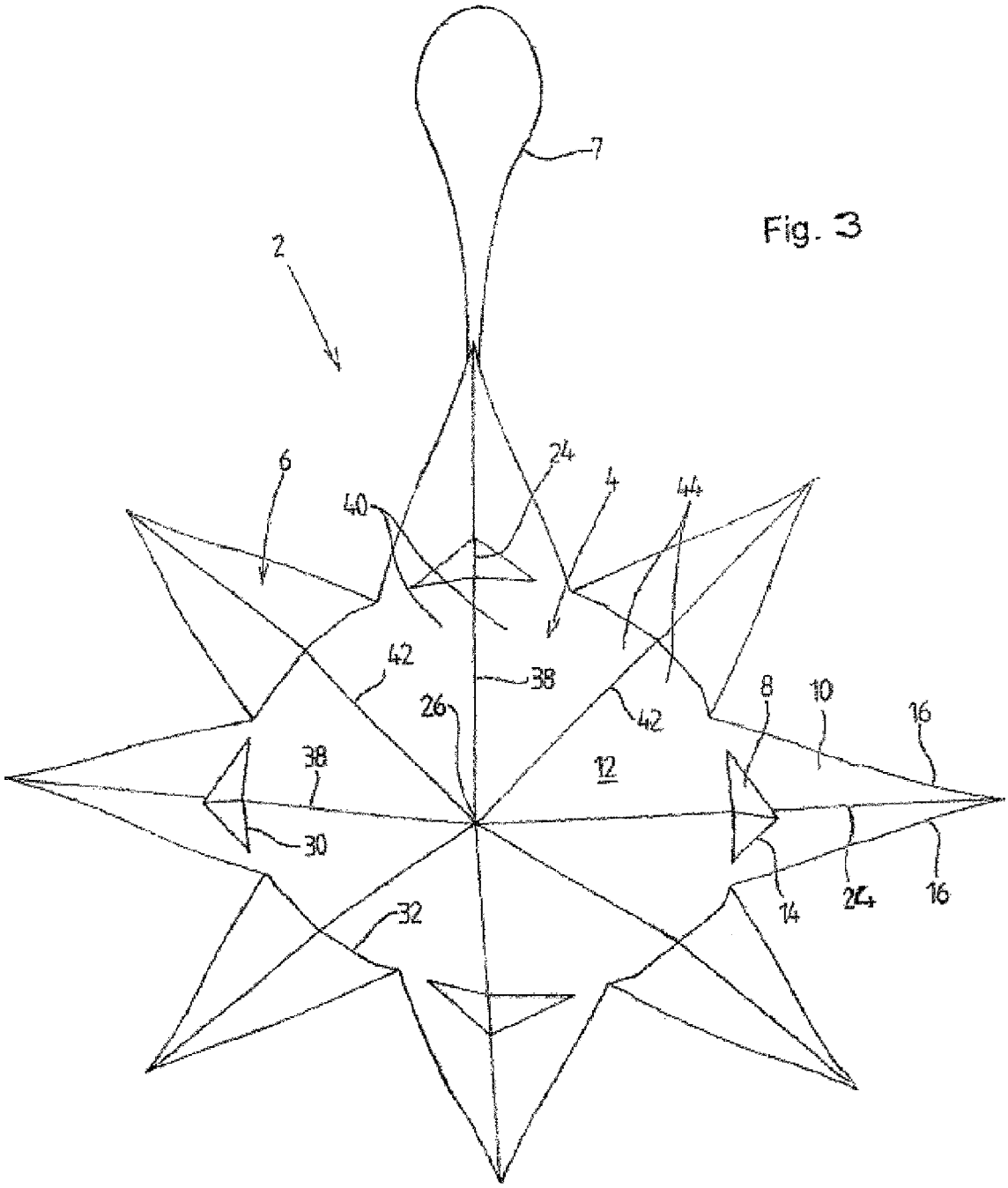
FIG. 3 is a view of the folded star from FIG. 1 at a slant from front and above
Figure 4:
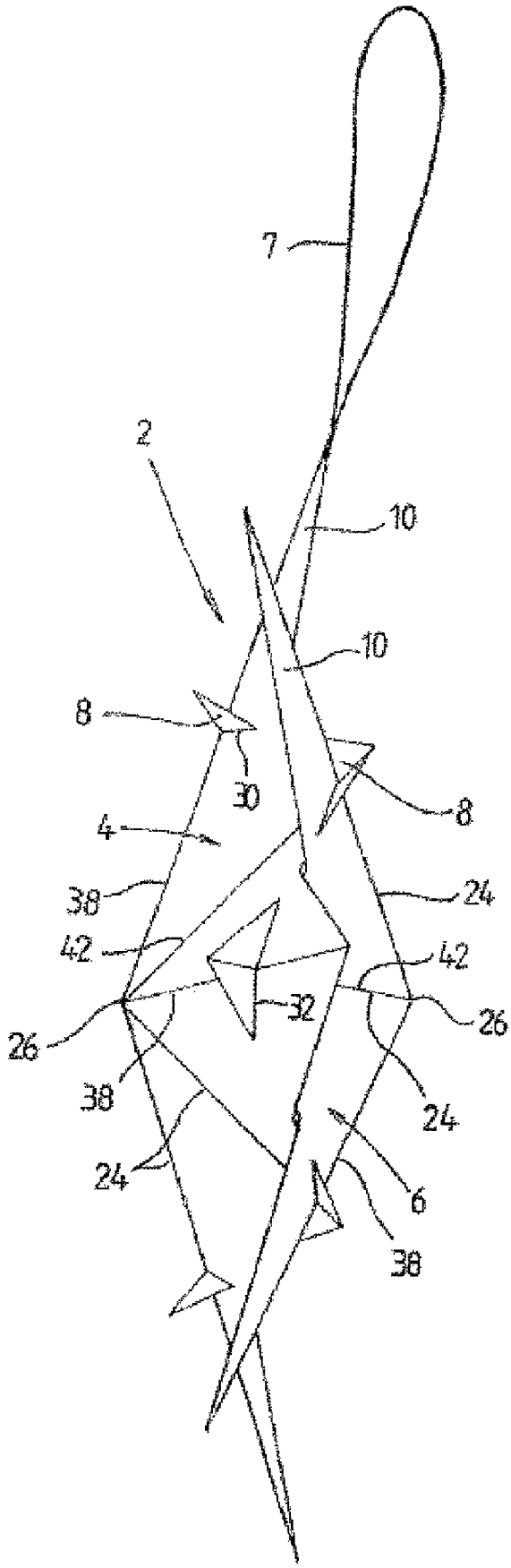
FIG. 4 is a side view of the folded star from FIG. 1.
Figure 5:
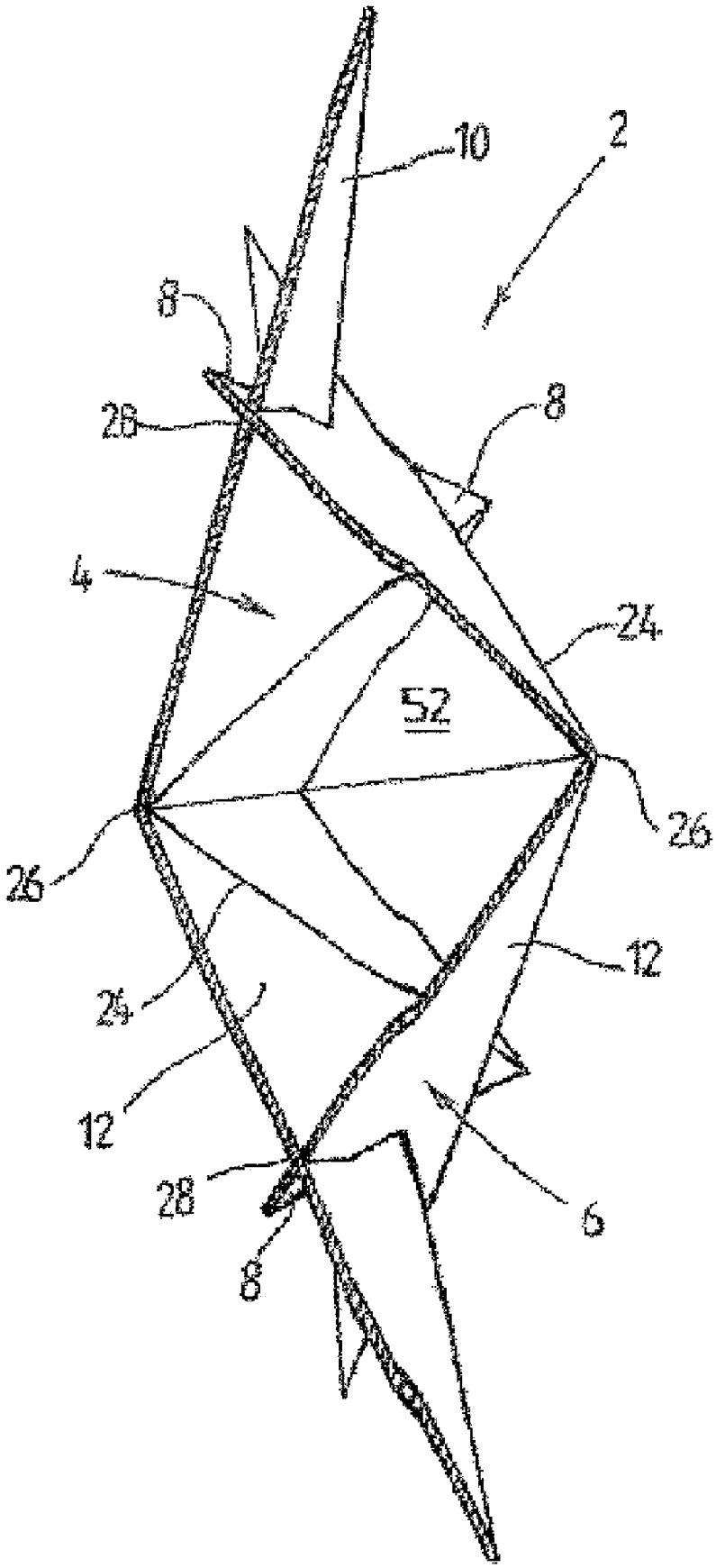
FIG. 5 is a sectional view of the folded star of FIG. 1 without hanger along the line V-V in FIG. 1.

Moreover, the tips of the V-shape-folded shorter points 8 of each blank 4, 6 extend through the slit openings 28 in the longer points 10, whereby on the opposite side of the folded star 2 they project slightly beyond the outwardly-folded areas 44 of the respective other blank 6,4, which have a V-shape cross-section. However, in comparison to the longer points 10, they are visually less pronounced, so that when viewing the front or back of the folded star 2, an impression of an eight-pointed star is obtained, as shown in FIG. 1 and FIG. 2.

Figure 7:
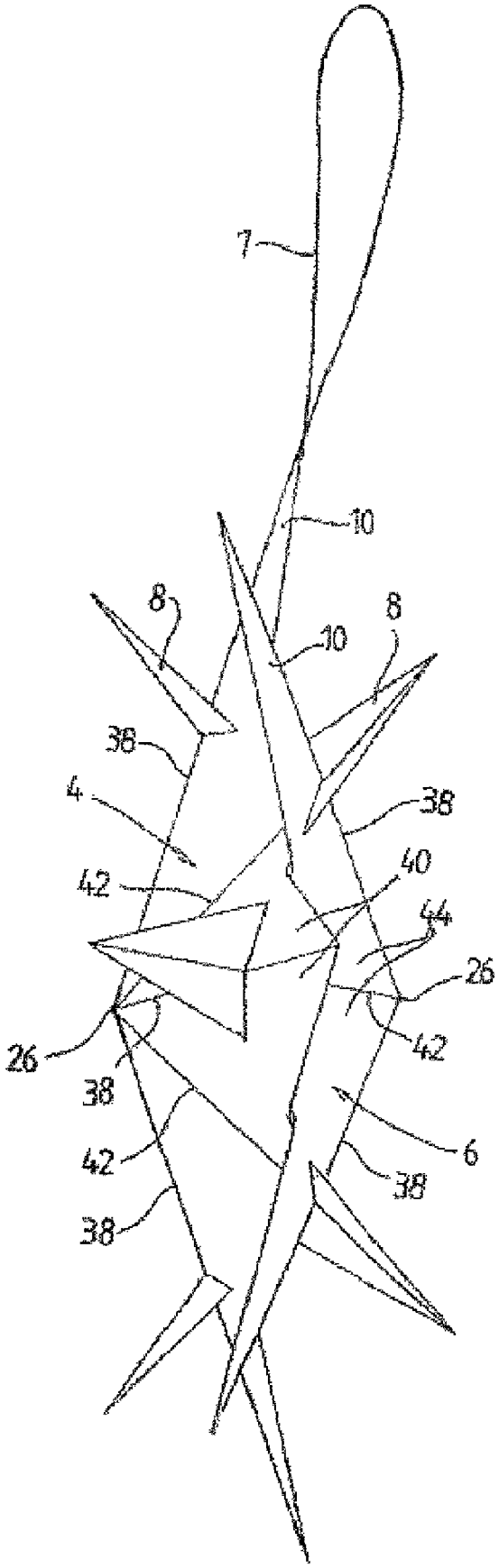
FIG. 7 is a side view of a first variation of the folded star.

However, if desired, the size of the projection of points 8 beyond the slit openings 28 can be enlarged by the lengthening and narrowing of the shorter points 8 to such an extent that, on the other side of the slit openings 28, these will have the same or similar length as the other points 10, through which, at least when viewed from the side, the impression of a folded star 2 with a larger number of points 8, 10 is obtained, as shown in FIG. 7. The thickness of the folded star 2, that is, the distance between the midpoints 26 of the middle part 12 of the two blanks 4, 6, can be changed too, for example by placing the slit openings at a smaller or larger distance from the midpoint 28. Especially well-proportioned flat three-dimensional folded stars 2 are obtained when the slit openings 28 are arranged somewhat radially outwardly from the bottom lines 20 of the larger points 10.

Figure 9:
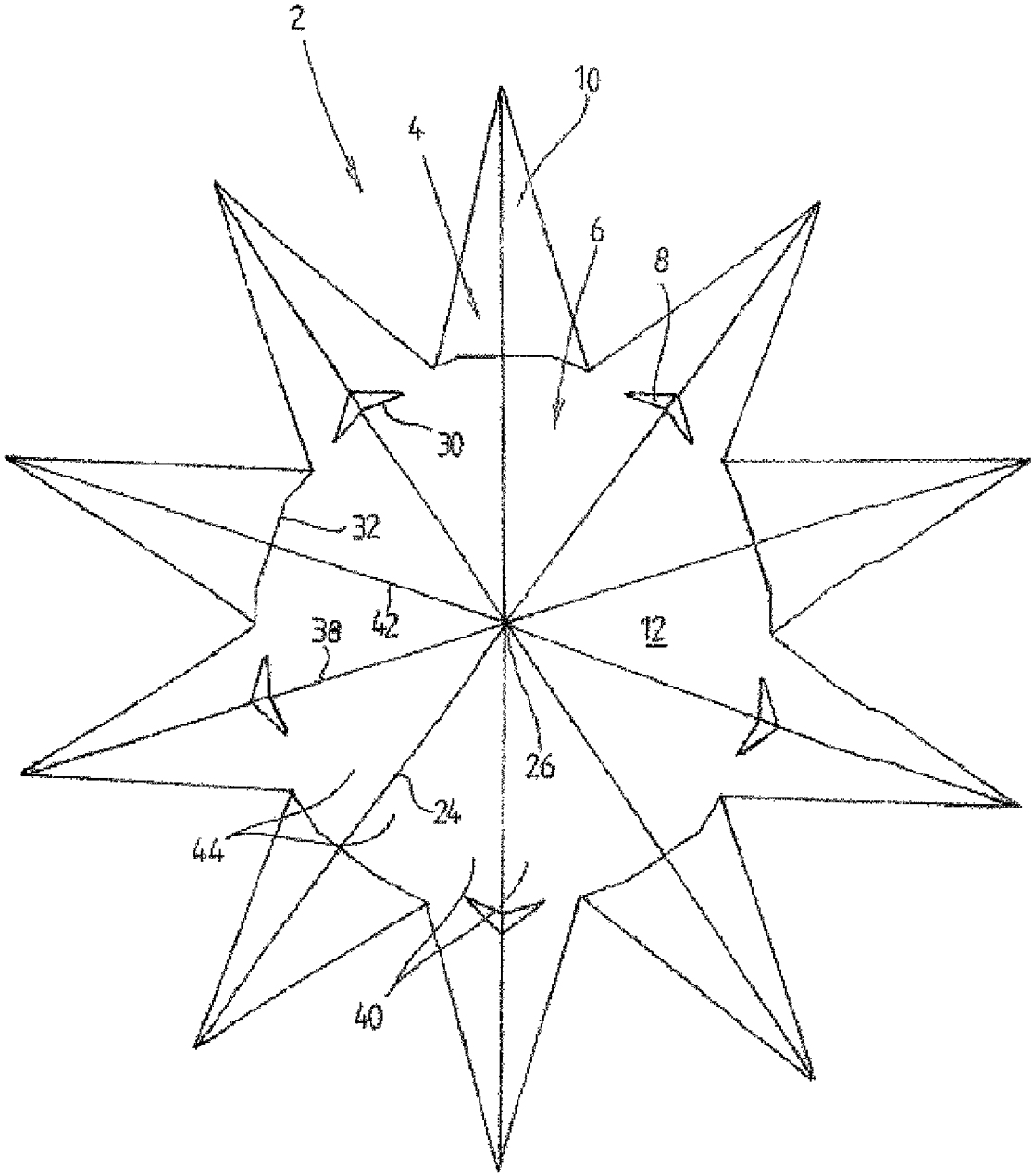
FIG. 9 is a front view of a ten-point folded star.

Furthermore, the folded star 2 can be provided with a larger or smaller number of larger and smaller points 8, 10 by providing the blanks 4, 6 with a total of ten or twelve points 8, 10 or any arbitrary even number of points 8, 10, instead of four larger points 10 and four shorter points 8, and by joining these together in the manner described above. A folded star 2 produced in this way with a total of ten longer points 10 is shown in FIG. 9, while FIG. 10 shows a six-point folded star 2 with six longer points 10 and FIG. 11 shows one of the two identical blanks 58, 60 used for producing the folded star 2 shown in FIG. 10.

Figure 10:
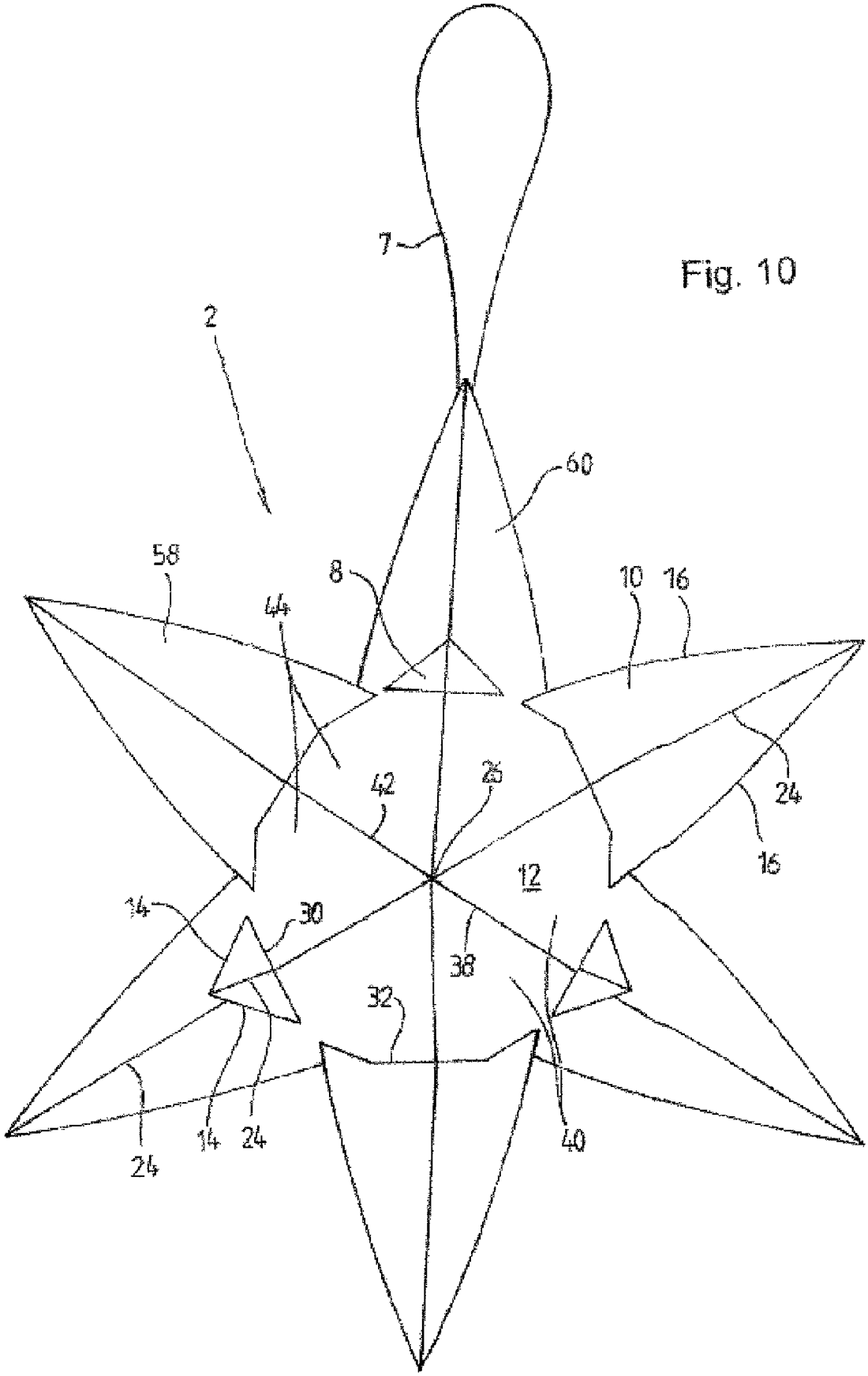
FIG. 10 is a front view of a six-point folded star.
Figure 11:
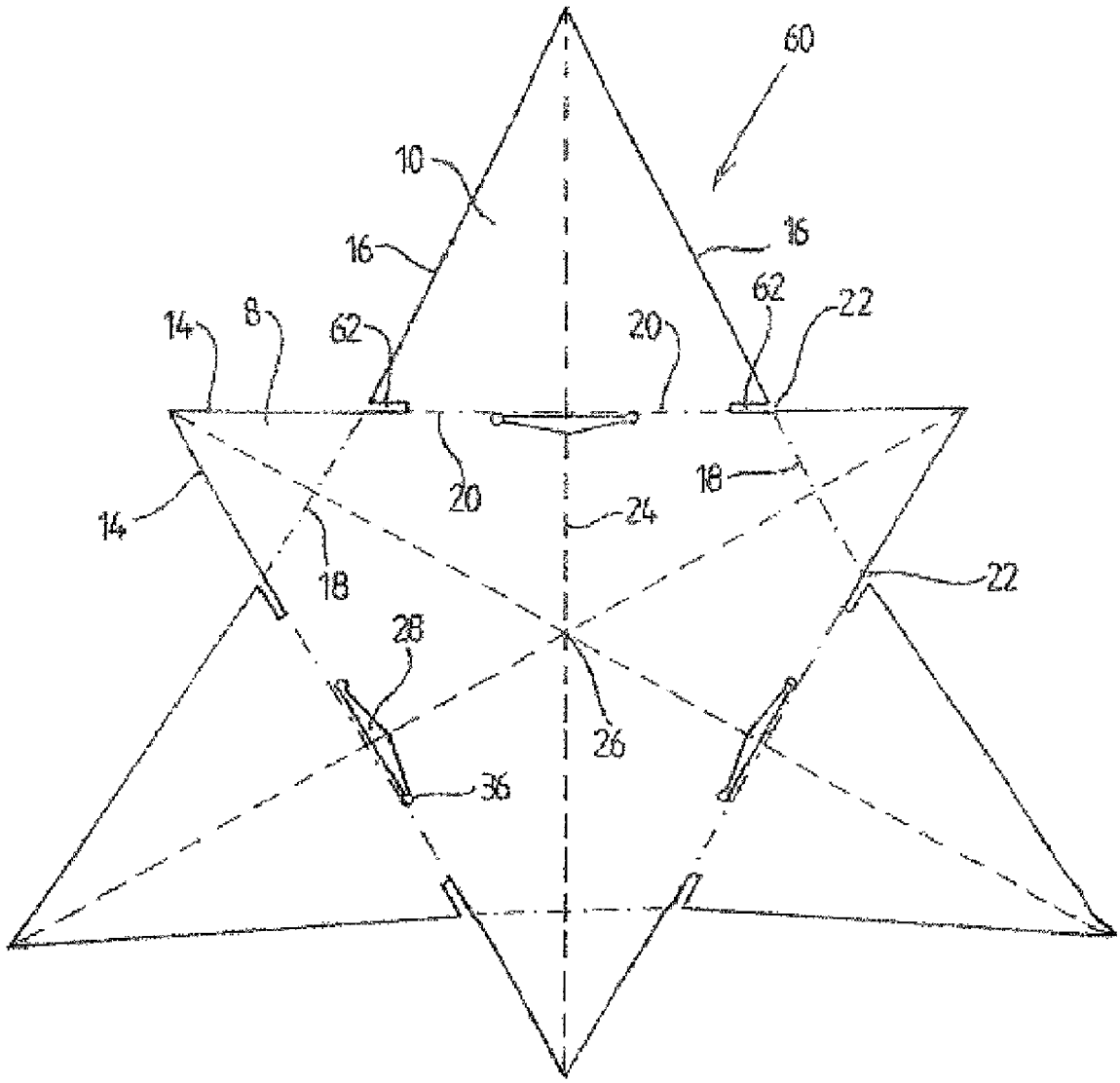
FIG. 11 is a top view onto a blank for the two halves of the folded star from FIG. 10.

Apart from a different number of longer points 10 and shorter points 8, the folded star 2 shown in FIG. 10 also exhibits a few other smaller differences in comparison to the folded star 2 shown in FIGS. 1 to 5. First of all, in the case of the folded star 2 from FIG. 10, the blanks 58, 60 along each fold line 24 running diagonally through their midpoint 26, are not folded in a single direction, but in one direction along one half of the fold line 24 and in the opposite direction along the other half of the fold line 24, that is, on the other side of midpoint 26, so that an inwardly-folded area 44 lies diagonally across from an outwardly-folded area 40 and not an outwardly-folded area 40 as in the folded star 2 from FIGS. 1 to 5. Secondly, the longer points 10 of blanks 58, 60, provided with the slit openings 28, have at their baseline 20 two cut-outs 62 open at the edges, these extending from opposite side edges 16 of the points 10 along the baseline 20 a short distance in the direction of the neighboring front ends of the slit openings 28. When joining the two blanks 58, 60, these cut-outs 62 can engage in each case with a corresponding cut-out 62 of the other blank 60, 58, which, in the completed folded star 2, leads to a mutual overlapping of the side edges 16 of neighboring points 10 and thus it has a somewhat different appearance as a consequence. However, on the other hand, this measure also has the effect that the two blanks 58, 60 lie more tightly against each other along their peripheral contacting line and due to the additional interleaving in the area of the cut-outs 62 will be held together even stronger. A similar result is achieved when the points 10 are provided with a cut-out 62 only at one of their side edges 16, which then must be arranged on the same side of all points 10.

Figure 8:
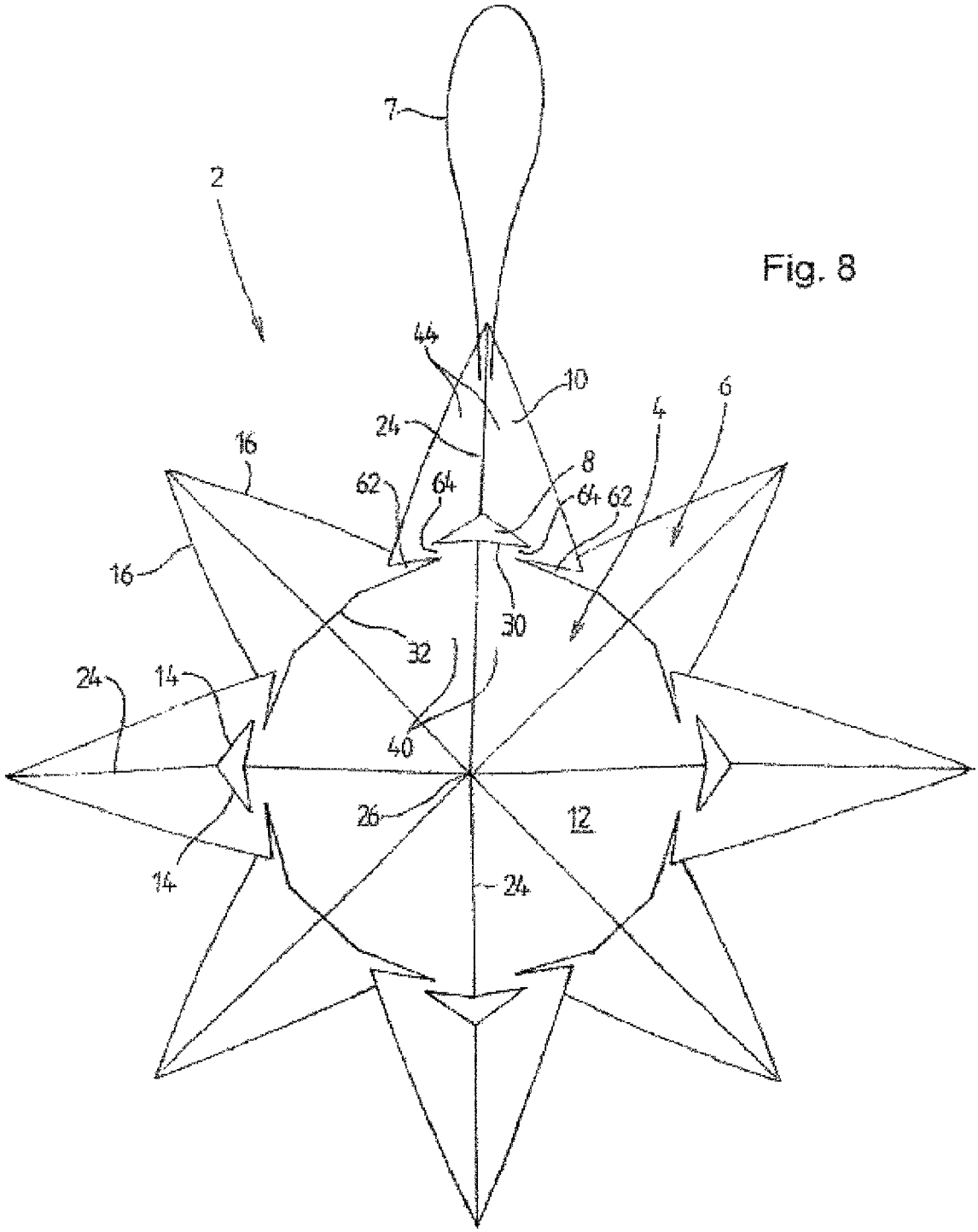
FIG. 8 is a front view of another variation of the folded star.

When the cut-outs 62 are extended to the vicinity of the opposite front ends of the slit openings 28, as it is shown in the case of the eight-point folded star 2 in FIG. 8, the tips of the larger points 10 can be turned down or reversely folded on the other side of the slit openings 28 along their fold lines 24. Then the two flanks of the points 10 form an inwardly-folded area 44 on the other side of slit openings 28, which is connected through two narrow material bridges 64 between the front ends of slit openings 28 and the ends of the cut-outs 62 with which an outwardly-folded area 40 on this side of slit openings 28 is connected. In this way, using simple means, a significantly different appearance can be produced in the perspective view (not shown).

Figure 15:
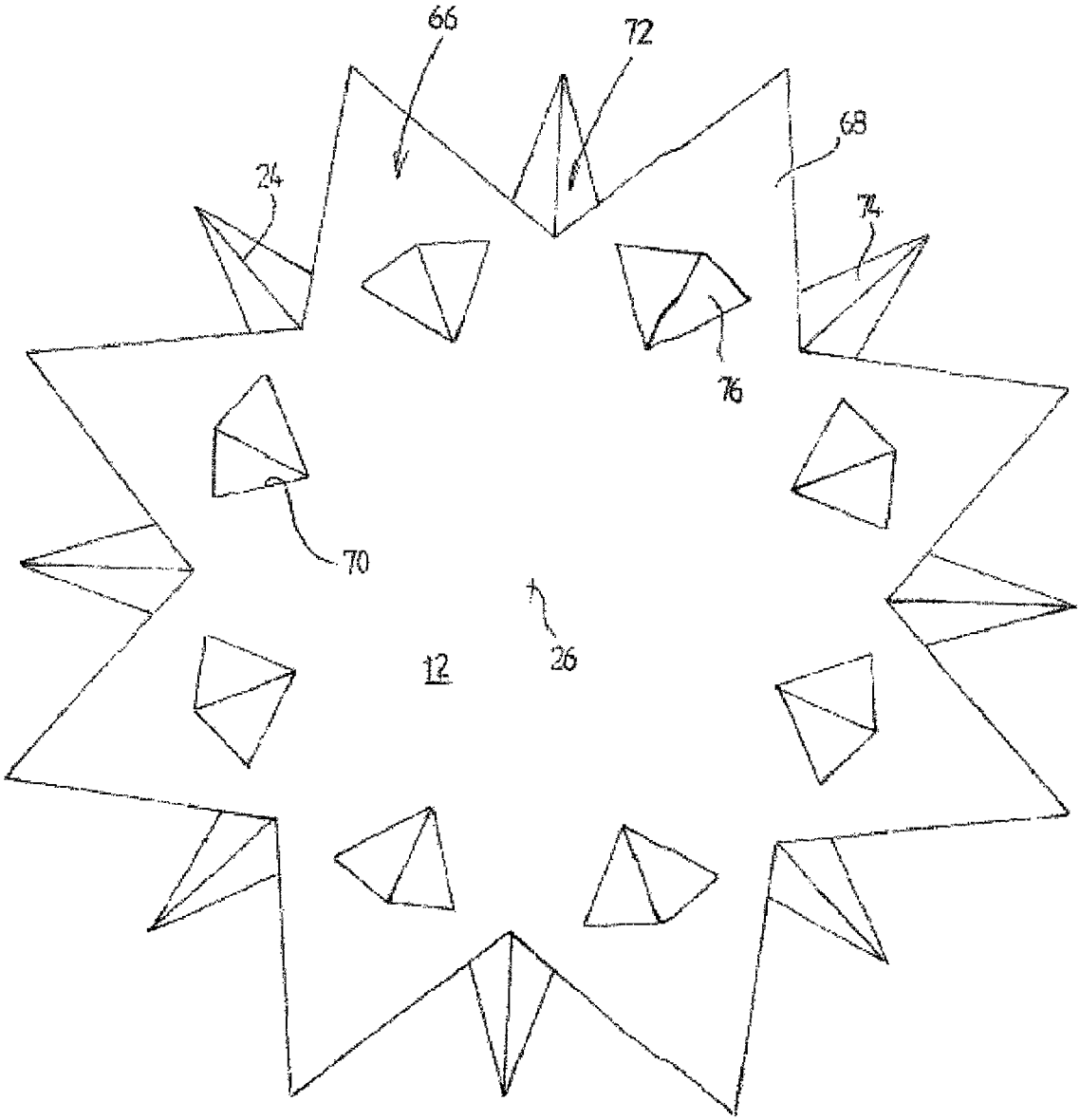
FIG. 15 is a view from the back of the folded star from FIG. 13.
Figure 16:
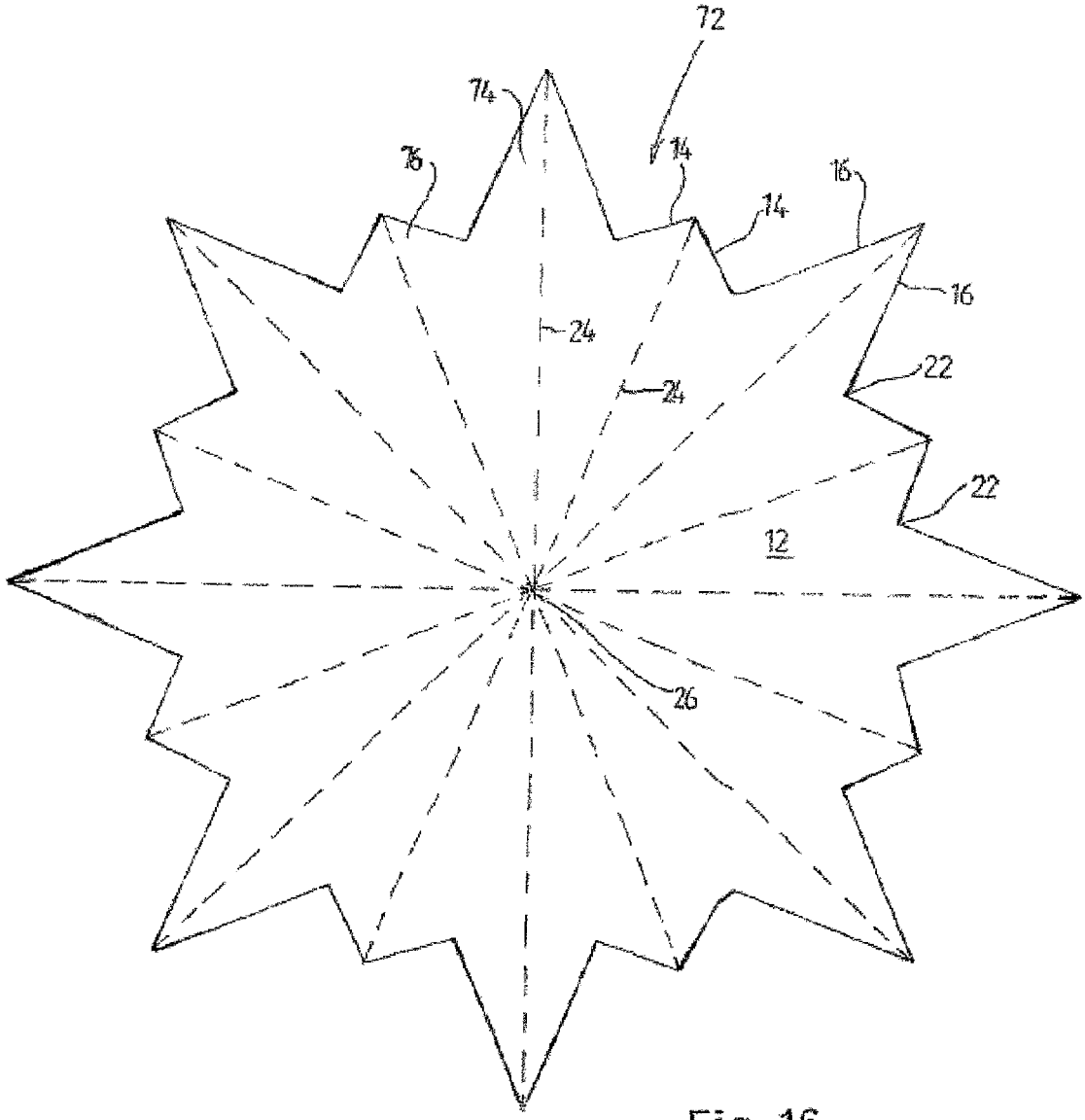
FIG. 16 is a top view onto the blank, provided with fold lines, of the folded star from FIGS. 13 to 16.
Figure 17:
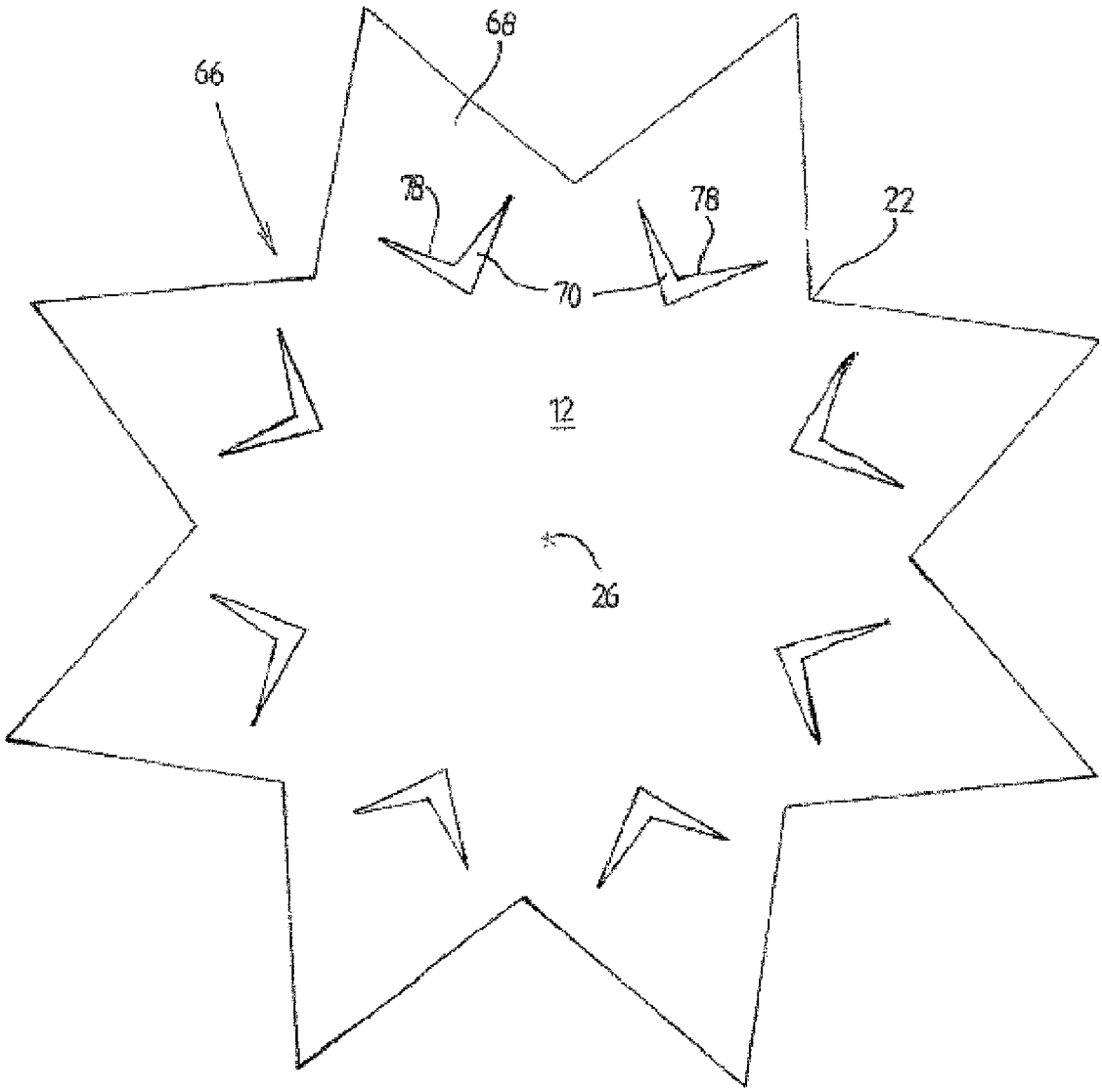
FIG. 17 is a top view onto the flat blank of the folded star from FIGS. 13 to 16.

In contrast to the folded stars 2 described above, which consist of two identical blanks 4, 6, each provided with fold lines 24, one of the two blanks 66 of the folded star 2 represented in FIGS. 13 to 15 is flat, as shown in FIG. 17, whereby it has a total of eight equal-sized triangular points 68 arranged at the same angular distances and projecting radially beyond a middle part 12 and the same number of equal-sized V-shaped slit openings 70, which are each located at the transition between one of the points 68 and the flat middle part 12 of blank 66 with no fold lines. As shown in FIG. 16, the other blank 72 has eight longer points 74 and eight shorter points 76 which alternate in the peripheral direction and are also arranged at the same angular distances. Apart from the fact that the number of points 74, 76 is larger than the number of points 8, 10 in the blanks 4, 6; 58, 60 described before, the blank 72 differs from these only in the fact that it has no slit opening, since these are all stamped out from the other blank 66. While the tips of the shorter points 76 arranged on the inwardly-folded areas 44 of this blank 72 are inserted through the slit openings 70 of the flat blank 66 and project beyond its bottom side, the longer points 74 with their tips project radially to the outside in the intermediate spaces between two adjacent points 68 of the flat blank 66, as is shown best in FIGS. 14 to 16. When viewing in the direction of the arrow in FIG. 14, thus one obtains the impression of a sixteen-point folded star with a raised middle part 12 having eight points 74 and eight flat points 68 which are arranged in the intermediate spaces between the points 74.

As can be seen best in FIG. 17, the outer bordering edges 78 of the slit openings 70 of the flat blank 64 each consist of two halves or edge sections converging in a V-shape. The length of the two edge sections and the angle enclosed by them are preferably chosen so that the outer bordering edges 78 of the slit openings 70 of blank 66, after the joining of the two blanks 66, 72 along their entire length, lie against the flanks of the inwardly-folded areas 44 of the other blank 72 and are in alignment with the side edges 16 of the longer points converging toward the tips, as is shown best in FIG. 14. By changing the distance of the slit openings 70 from the midpoint 26 of the blank 66, the size of the projecting length of the folded blank 72 beyond the plane of blank 66 can be altered. If desired, in addition the contrast between the flat blank 66 and the raised folded blank 72 can be enhanced or emphasized by applying a different color to the blanks 66, 72.

Furthermore, the folded stars 2 shown in FIG. 1 to 11 can be equipped with an additional flat blank (not shown) which is sandwiched between the two folded blanks 4, 6; 58, 60. The additional blank, like the blank 66 in FIG. 17, is provided with slit openings, through which all or a part of the shorter points 8 at the inwardly-folded areas 44 of the two other blanks 4, 6; 58, 60 are inserted with their tips. The shorter points 8 can each be additionally introduced through a slit opening 28 in the respective other folded blank 6, 4; 60, 58 or can be anchored only in the additional flat blank, whereby this blank then holds together the two folded blanks 4, 6; 58, 60. The flat blank subdivides the cavity 52 defined by the middle parts 12 of the blanks 4, 6; 58, 60 into two halves. However, it can have an opening in the middle in case such a subdivision is not desired.

The loops of thread 7 which serve to hang the folded stars 2 and which are shown only in the case of the folded star 2 in the figures, can be glued on the folded star 2 with their thread ends next to one another using an adhesive, preferably a hot melt adhesive, as shown in FIG. 2. Alternatively, however, the loop of thread 7 can also extend through a small round opening (not shown) in one or both blanks 4, 6. The attachment of the loop of thread is done expediently either in the middle of a larger point 10 or in the middle between two larger points 10.

In order to facilitate the attachment of the loop of thread 7, this can also extend through a V-shaped cut-out symmetrically to fold line 38, converging toward middle part 12, in one of the larger points 10.

The folded stars 2 can be made in different sizes and are used preferably for Advent or Christmas decoration, for example as window stars or as tree ornaments for a Christmas tree, but also as lanterns, as lampshades for light fixtures or as packaging containers, for example for the packaging of small objects, such as jewelry. Furthermore, a plurality of the folded stars 2 can be lined up along a string of lights, whereby the lights are arranged inside the folded stars 2. When the folded stars 2 are made of a weather-resistant material, trees or shrubs in gardens or parks can, for example, be decorated with illuminated folded stars 2 lined up on a string of lights.

Figure 12:
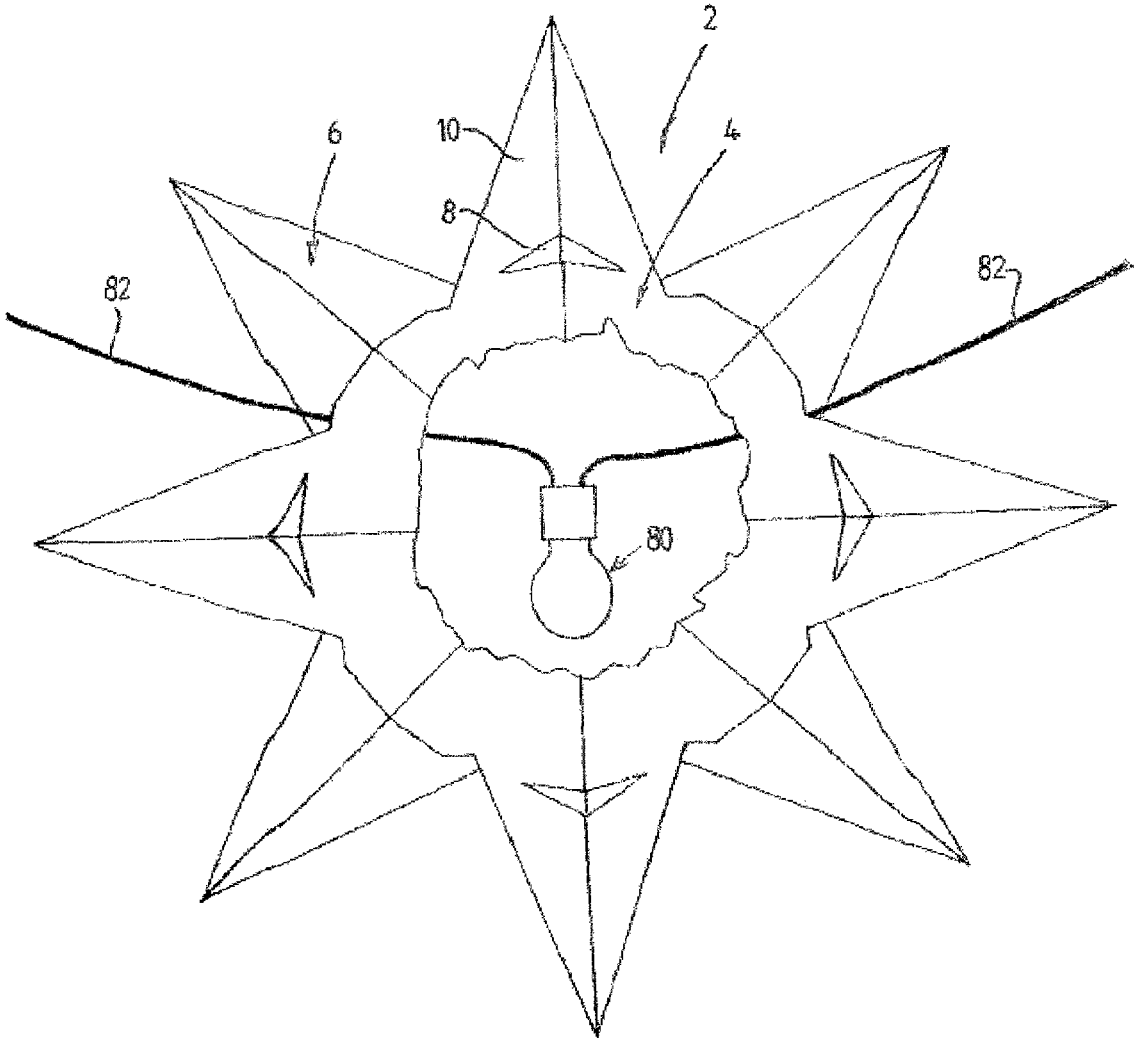
FIG. 12 is a partially cut-away front view of the folded star from FIGS. 1 to 5 with illumination.

FIG. 12 shows a single folded star 2 of such a string of lights, which is made of a transparent paper or foil material. The light arranged inside it in the form of an electrical incandescent light 80 is connected through two cables 82 to a power source (not shown). The cables 82 each enter into the cavity 52 enclosed by the middle parts 12 of the blanks 4, 6, between two opposing re-entering corners 22 of the two blanks 4, 6, and serve at the same time for hanging the folded stars 2 of the string of lights so that loops of thread can be omitted here. Alternatively, the folded star 2 shown in FIG. 12 can also be hung as an illuminated solitary light on a single two-line cable (not shown).

Figure 18:
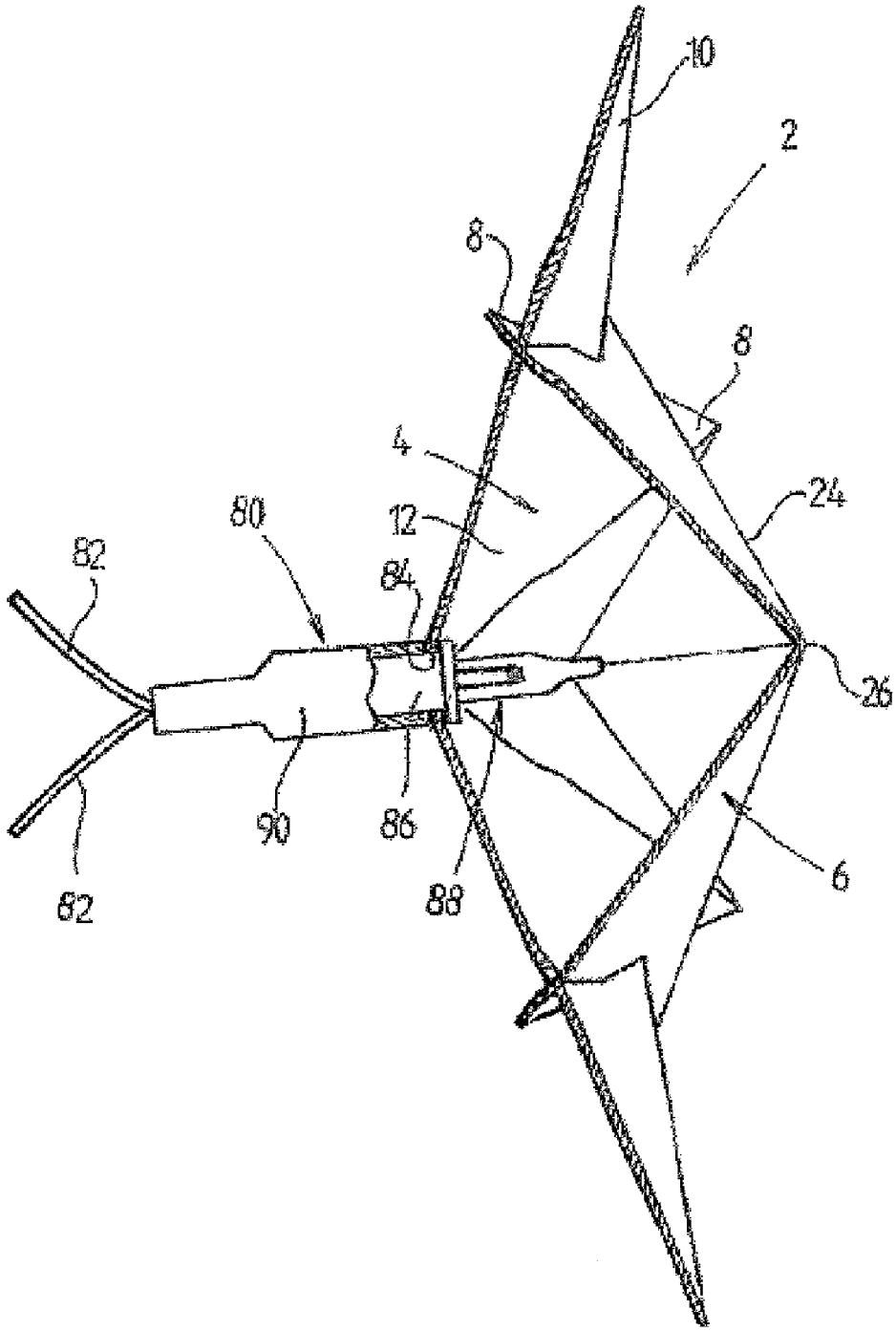
FIG. 18 is a sectional view of the folded star from FIGS. 1 to 5 with illumination.

FIG. 18 shows another possibility of the combination of a folded star 2 with an electrical incandescent light 80 of a commercial string of lights. One of the blanks 4 of the folded star has there in the middle part 12 a circular opening 84 concentric to its midpoint 26 for a socket 86 for an incandescent bulb 88 of the light 80, which, after entering through the opening 84, is inserted in the known manner into a complementary lamp mounting 90 connected to the cable 82, in order to clamp the edge of the opening 84 between the socket 86 and the mounting 90 before the two blanks 4, 6 are connected to one another. In order to support the attachment of the blank 4 between the socket 86 and the mounting 90, instead of the stamped round opening 84, one can also stamp radial cuts starting from the midpoint 26 with a length corresponding to the radius of the opening 84 in blank 4. In this case, the triangular sections formed between the cuts are bent to the outside of the blank 4, and when the socket 86 is inserted into the mounting 90 they are firmly secured between these two (not shown).

The invention claimed is:

1. Star-shaped decorative object (2), comprising two blanks of a sheet material (4, 6) joined together, both blanks (4, 6) having a middle part (12) and a plurality of shorter and longer points (8, 10) extending outwardly beyond the middle part (12) toward a tip at an outer end of the points (8, 10), whereby the middle parts (12) of the blanks (4, 6) are each provided with several fold lines (24) running from a midpoint (26) toward the tips of the points (8, 10) and is folded at neighboring fold lines (24) alternately in a V-shape in opposite directions so that between each two fold lines (24) separated by another fold line (24) inwardly-folded or outwardly-folded areas (44 or 40) are formed with the other fold line (24) in the middle, wherein the tips of the shorter points (8) on inwardly-folded areas (44) of each of the two blanks (4, 6) are inserted through openings (28) on outwardly folded areas (40) of the other one of the two blanks (6, 4), which openings (28) are each disposed on the fold lines (24) running from the midpoint (26) toward the tips of the longer points (10), such that the tips of the shorter points (8) project through the openings (20) in order to join the two blanks (4, 6) for the formation of a hollow three-dimensional body.

2. Star-shaped decorative object according to claim 1, wherein the three-dimensional body encloses an essentially closed cavity (52).

3. Star-shaped decorative object according to claim 1, wherein at least some of the longer points (10) on the outwardly-folded areas (40) of one of the blanks (4, 6) are arranged between neighboring longer points (10) of the other blank (6, 4).

4. Star-shaped decorative object according to claim 1, wherein the two blanks (4, 6) are essentially the same.

5. Star-shaped decorative object according to claim 1, wherein the points (8) on the inwardly-folded areas (44) of one of the blanks (4, 6) are inserted through openings (28) in the outwardly-folded areas (40) of the other blank (6, 4) and/or of another blank introduced between the blanks in order to join the blanks (4, 6) together.

6. Star-shaped decorative object according to claim 1, wherein longer points (10) alternate with shorter points (8) and wherein the shorter points (8) are inserted through openings (28) in the longer points (10).

7. Star-shaped decorative object according to claim 1, wherein at least a part of the points (8) are interlocked in openings (28) in order to make it more difficult for the points (8) to come loose from the openings (28).

8. Star-shaped decorative object according to claim 1, wherein the width of the points (8) on the inwardly-folded areas (44) is somewhat smaller or the same as the width of the points (10) on the outwardly-folded areas (40).

9. Star-shaped decorative object according to claim 1, wherein opposite side edges (14) of the points (8) that extend through the openings (28) lie on both sides of the openings (28) in line contact against the points (10) that are provided with openings.

10. Star-shaped decorative object according to claim 1, wherein a loop of thread (7) serves as hanger.

11. Star-shaped decorative object according to claim 1, formed at least partly of a translucent or transparent sheet material and having a light source (80) arranged inside it.

12. String of lights with a plurality of electrical lights (80) that are lined up along a common cable (82, 84) and connected through the cable (82, 84) to a power source, wherein at least part of the lights (80) are arranged inside a star-shaped decorative object according to claim 1.

13. Set of two blanks of a sheet material (4, 6) for the production of a star-shaped decorative object (2), whereby both blanks (4, 6) have a middle part (12) and a plurality of shorter and longer points (8, 10; 74, 76) extending outwardly beyond the middle part (12) toward a tip at an outer end of the points (8, 10), whereby the middle parts (12) of the blanks (4, 6) are each provided with several fold lines (24) running from a midpoint (26) toward the tips of the points (8, 10) so that they can be folded at neighboring fold lines (24) alternately in a V-shape, in opposite directions, whereby between each two fold lines (24) separated by another fold line (24), inwardly- or outwardly-folded areas (44 or 40) are formed respectively with the other fold line (24) in the middle, wherein each of the two blanks (6, 4) has a plurality of openings (28) through which the tips of the shorter points (8) on inwardly-folded areas (44) of the other of the two blanks (4, 6) can be inserted for the formation of a hollow three-dimensional body, such that the tips of the shorter points (8) project through the openings (28), the openings (28) of each blank (4, 6) being disposed on the fold lines (24) running from the midpoint (26) toward the tips of the longer points (10).

14. Set of blanks according to claim 13, wherein at least a part of the openings are formed as slit openings (28).

15. Set of blanks according to claim 13, wherein at least a part of the openings (28) are symmetrical to a fold line (24).

16. Set of blanks according to claim 13, wherein at least a part of the openings (28, 70) have a V-shaped opening cross-section.

17. Set of blanks according to claim 13, wherein the fold lines (24) run from the midpoint (26) radially or spirally outward.

18. Set of blanks according to claim 13, and additionally including at least one flat star-shaped blank.

19. Star-shaped decorative object (2), comprising at least two blanks (66, 72) joined together, made of a sheet material, of which one is flat and of which at least one (72) has a middle part (12) and a plurality of points (74, 76) extending outwardly beyond the middle part (12) toward a tip at an outer end of the points (74, 76), whereby the middle part (12) is provided with several fold lines (24) running from a midpoint (26) toward the tips of the points (74, 76) and is folded at neighboring fold lines (24) alternately in a V-shape in opposite directions, so that between each two fold lines (24) separated by another fold line (24) inwardly-folded or outwardly-folded areas (44 or 40) are formed, with the other fold line (24) in the middle, wherein the points (76) on the inwardly-folded areas (44) are shorter than the points (74) on the outwardly-folded areas (40) and are inserted through V-shaped openings (28) of the flat blank (66) such that the tips of the shorter points (8) project through the openings (28) in order to join the two blanks (4, 6) for the formation of a hollow three-dimensional body.

* * * * *

UNITED STATES PATENT AND TRADEMARK OFFICE

CERTIFICATE OF CORRECTION

PATENT NO. : 7,927,673 B2
APPLICATION NO. : 11/577579
DATED : April 19, 2011
INVENTOR(S) : Gotz Thomas It is certified that error appears in the above-identified patent and that said Letters Patent is hereby corrected as shown below:

On page 1, under "U.S. Patent Documents," please remove the U.S. Patent No. 5,280,627 A citation.
On page 1, under "Foreign Patent Documents," please remove the CN 1163006 citation.
On page 2, under "Foreign Patent Documents," please remove the EP 0 654 733 A1 citation and the WO 94/27234 citation.
In the claims: column 13, claim 13, line 49, please delete "74, 76".

Signed and Sealed this
Twenty-ninth Day of November, 2011

David J. Kappos

David J. Kappos
*Director of the United States Patent and Trademark Office*